US009460871B2

(12) United States Patent
Naka et al.

(10) Patent No.: US 9,460,871 B2
(45) Date of Patent: Oct. 4, 2016

(54) METHOD FOR ASSEMBLING ARC-EXTINGUISHING CHAMBER OF ELECTROMAGNETIC CONTACTOR

(75) Inventors: Yasuhiro Naka, Kounosu (JP); Kouetsu Takaya, Kounosu (JP); Kenji Suzuki, Kounosu (JP)

(73) Assignees: FUJI ELECTRIC FA COMPONENTS & SYSTEMS CO., LTD., Tokyo (JP); FUJI ELECTRIC CO., LTD., Kawasaki-Shi (JP)

( * ) Notice: Subject to any disclaimer, the term of this patent is extended or adjusted under 35 U.S.C. 154(b) by 188 days.

(21) Appl. No.: 14/006,535

(22) PCT Filed: Apr. 3, 2012

(86) PCT No.: PCT/JP2012/002332

§ 371 (c)(1),
(2), (4) Date: Oct. 3, 2013

(87) PCT Pub. No.: WO2012/157175

PCT Pub. Date: Nov. 22, 2012

(65) Prior Publication Data

US 2014/0013583 A1 Jan. 16, 2014

(30) Foreign Application Priority Data

May 19, 2011 (JP) ..... 2011-112917

(51) Int. Cl.
*H01H 11/00* (2006.01)
*H01H 11/02* (2006.01)
(Continued)

(52) U.S. Cl.
CPC ..... *H01H 11/00* (2013.01); *H01H 1/66* (2013.01); *H01H 9/443* (2013.01); *H01H 49/00* (2013.01);
(Continued)

(58) Field of Classification Search
CPC ..... H01H 1/66; H01H 9/443; H01H 11/06; H01H 49/00; H01H 50/14; H01H 50/163; H01H 50/045; H01H 50/38; H01H 51/065; Y10T 29/49002; Y10T 29/4902; Y10T 29/49073; Y10T 29/49105; Y10T 29/49815; Y10T 29/49826; Y10T 29/49904; Y10T 29/49915; Y10T 29/49936
USPC ..... 29/426.1, 428, 469, 521, 524.1, 525.06, 29/592.1; 335/131, 151–154, 185, 194, 335/201, 248, 252
See application file for complete search history.

(56) References Cited

U.S. PATENT DOCUMENTS 5,892,194 A 4/1999 Uotome et al.
7,286,031 B2 * 10/2007 Nishida et al. ..... 335/132
(Continued)

FOREIGN PATENT DOCUMENTS

JP H06-203725 A 7/1994

OTHER PUBLICATIONS

Europe Patent Office, "Search Report for EP 12785001.4," Jan. 28, 2015.

*Primary Examiner* — Paul D Kim
(74) *Attorney, Agent, or Firm* — Manabu Kanesaka

(57) ABSTRACT

A method for assembling an arc-extinguishing chamber of an electromagnetic contactor includes a step of fixing a pair of fixed contacts each including a support conductor and a C-shaped part, to a bottom plate part of the arc-extinguishing chamber having a tub-shape with one end being open, the C-shaped part defining inside of the arc-extinguishing chamber; a step of installing an insulation cover covering a part other than a contact point part of each C-shaped part of the pair of fixed contacts; and a step of disposing a movable contact to be capable of contacting to and separating from the contact point parts of the fixed contacts.

1 Claim, 13 Drawing Sheets

(51) Int. Cl.

| | |
|---|---|
| ***H01H 11/04*** | (2006.01) |
| ***H01H 65/00*** | (2006.01) |
| ***H01H 9/44*** | (2006.01) |
| ***H01H 50/14*** | (2006.01) |
| ***H01H 50/16*** | (2006.01) |
| ***H01H 50/38*** | (2006.01) |
| ***H01H 51/06*** | (2006.01) |
| ***H01H 49/00*** | (2006.01) |
| ***H01H 1/66*** | (2006.01) |
| ***H01H 50/04*** | (2006.01) |
| *H01H 50/02* | (2006.01) |

(52) U.S. Cl.

CPC ..... *H01H 50/045* (2013.01); *H01H 50/14* (2013.01); *H01H 50/163* (2013.01); *H01H 50/38* (2013.01); *H01H 51/065* (2013.01); *H01H 2050/025* (2013.01); *Y10T 29/49105* (2015.01)

(56) References Cited

U.S. PATENT DOCUMENTS

| | | | | |
|---|---|---|---|---|
| 8,760,247 | B2 * | 6/2014 | Isozaki et al. | 335/201 |
| 8,823,472 | B2 * | 9/2014 | Takaya et al. | 335/133 |
| 8,994,482 | B2 * | 3/2015 | Yokoyama et al. | 335/201 |
| 2004/0080389 | A1 | 4/2004 | Nishida et al. | |
| 2005/0148216 | A1 | 7/2005 | Nishida et al. | |
| 2009/0096559 | A1 | 4/2009 | Yano et al. | |
| 2009/0237191 | A1 | 9/2009 | Yano et al. | |

* cited by examiner

Fig. 9(a)
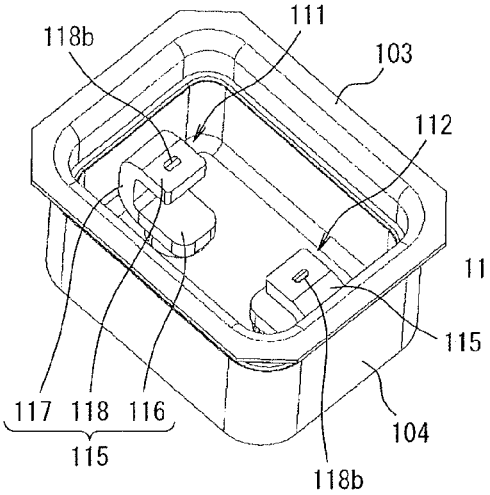
Fig. 9(b)
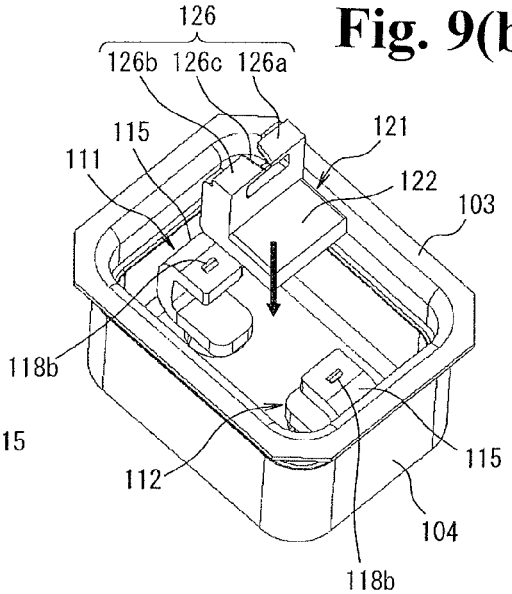
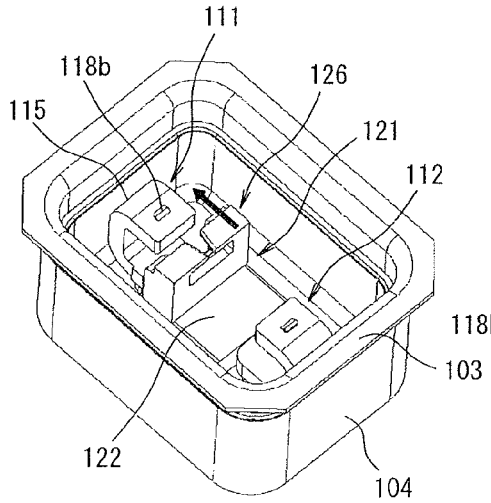
Fig. 9(c)
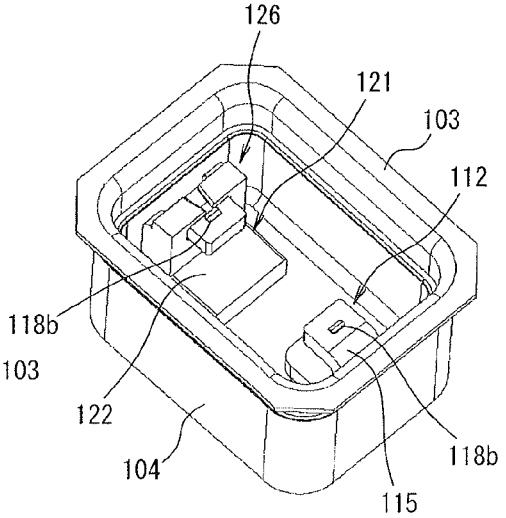
Fig. 9(d)

METHOD FOR ASSEMBLING ARC-EXTINGUISHING CHAMBER OF ELECTROMAGNETIC CONTACTOR

RELATED APPLICATIONS

The present application is National Phase of International Application No. PCT/JP2012/002332 filed Apr. 3, 2012, and claims priority from Japanese Applications No. 2011-112917 filed May 19, 2011.

TECHNICAL FIELD

The present invention relates to a method for assembling an arc-extinguishing chamber of an electromagnetic contactor in which a contact point mechanism with a fixed contact and movable contact is stored in the arc-extinguishing chamber.

BACKGROUND ART

As an electromagnetic contactor having a contact point mechanism stored in an arc-extinguishing chamber of the electromagnetic contactor, there is proposed, for example, a sealed contact device that has a sealed container made of ceramic or other heat-resistance material and shaped into a box with one open surface (see Patent Document 1, for example). In the sealed contact device described in Patent Document 1, fixed terminals are brazed and airtightly bonded to two through-holes formed in a bottom part of the sealed container. A movable contact is disposed in the sealed container. The movable contact is provided with a movable contact point that contacts with and separates from fixed contact points formed at the fixed terminals. An open end part of the sealed container is connected to a first bonded member by a tubular metallic second bonded member, the first bonded member being shaped into a rectangle by means of a magnetic metallic material and has a bottomed tubular part seal-bonded thereto.

Patent Document 1: Japanese Patent Publication No. 3107288

Incidentally, in the conventional example described in Patent Document 1, the sealed container is formed into a box with one open surface by using ceramic or other heat-resistance material, and the fixed terminals are brazed to the sealed container. In this sealed container, tip ends of the fixed contact points protrude into the sealed container to fix the fixed terminals to a bottom plate part of the sealed container. The movable contact is disposed facing a lower side of the fixed contact points to be capable of contacting with and separating from the fixed contact points.

Therefore, when assembling the sealing container, no special assembly method is needed because the fixed terminals can simply be disposed fixedly in the sealed container. However, when a large current flows in a closed pole state where the movable contact contacts the fixed terminals, electromagnetic repulsive force acts in an open pole direction in which the movable contact separates from the fixed terminals, making the contact state between the fixed terminals and the movable contact unstable.

In order to solve this problem and stabilize the contact state between the fixed terminals and the movable contact, there is considered a way to generate the Lorentz force that acts against the electromagnetic repulsive force, by bending each fixed terminal into an L-shape or C-shape and disposing a coupling part, which is connected to a plate part in which a contact point part is disposed, in the vicinity of contact point parts of the fixed terminals and a contact point part of the movable contact.

DISCLOSURE OF THE INVENTION

In this case, forming each fixed terminal into an L-shape or C-shape makes the shape of the fixed terminal complicated. In addition, an arc that is generated when the movable contact separates from the fixed terminals needs to be stabilized by insulating the sections other than the contact point parts of the fixed terminals. This raises a need for installing an insulation member, complicating the processes for assembling the arc-extinguishing chamber.

The present invention was contrived in view of the unsolved problems of the conventional example described above, and an object of the present invention is to provide a method for assembling an arc-extinguishing chamber of an electromagnetic contactor, which can easily assemble an arc-extinguishing chamber when the shape of a fixed contact becomes complicated.

In order to achieve this object, a method for assembling an arc-extinguishing chamber of an electromagnetic contactor according to one aspect of the present invention has: a step of fixing a pair of fixed contacts each including a support conductor and a C-shaped part, to a bottom plate part of the arc-extinguishing chamber having a tub-shape with one end being open, the C-shaped part defining the inside of the arc-extinguishing chamber; a step of installing an insulation cover covering a part other than a contact point part of each C-shaped part of the pair of fixed contacts; and a step of disposing a movable contact to be capable of contacting with and separating from the contact point parts of the fixed contacts.

According to this configuration in which the arc-extinguishing chamber is assembled, first, the pair of fixed contacts each including the support conductor and the C-shaped part is fixed to the tub-shaped arc-extinguishing chamber. Subsequently the insulation cover is installed in the C-shaped parts of the fixed contacts, and then the movable contact is disposed between the fixed contacts so as to be capable of contacting with and separating from the contact point parts of the fixed contacts. Therefore, even when the fixed contact of a complicated configuration is applied, the arc-extinguishing chamber can be assembled easily.

According to the method for assembling an arc-extinguishing chamber of an electromagnetic contactor, it is preferred that the arc-extinguishing chamber have a configuration in which a ceramic is integrally shaped into a tub having one end being open.

According to this configuration, because the arc-extinguishing chamber is integrally formed with ceramic, the arc-extinguishing chamber itself can be formed easily.

According to the method for assembling an arc-extinguishing chamber of an electromagnetic contactor, it is preferred that the arc-extinguishing chamber be configured by a flat fixed contact point supporting insulating substrate supporting the pair of fixed contacts, a metallic angular cylindrical body brazed to the fixed contact point supporting insulating substrate, and an insulating cylindrical body disposed on an inner circumferential surface of the metallic angular cylindrical body.

According to this configuration, the arc-extinguishing chamber itself is formed with a fixed contact point supporting insulating substrate, a metallic angular cylindrical body, and an insulating cylindrical body. A metallization process for fixing a fixed contact point of the fixed contact point supporting insulating substrate and the metallic angular cylindrical body can be performed using a large number of fixed contact point supporting insulating substrates simultaneously. Thus, contact point assembly can be performed easily.

According to the method for assembling an arc-extinguishing chamber of an electromagnetic contactor, it is preferred that the insulation cover have: an L-shaped part covering inner surfaces of an upper plate part and intermediate plate part of the C-shaped part of each of the pair of fixed contacts; side plate parts extending from side edges of the L-shaped part to cover side surfaces of each C-shaped part; and a fitted part extending inward from an upper end of the side plate part facing the support conductor to fit a small diameter part formed in the support conductor.

According to this configuration, an unnecessary exposed part of each fixed contact having the C-shaped part is covered with the insulation cover, so that a direction in which an arc is generated when the movable contact point separates from the fixed contact can be stabilized. Therefore, the insulation cover can easily be attached to the fixed contact by simply fitting the fitted part into the small diameter part of the support conductor.

According to the method for assembling an arc-extinguishing chamber of an electromagnetic contactor, the insulation cover may have: an L-shaped part covering inner surfaces of an upper plate part and intermediate plate part of the C-shaped part of each of the pair of fixed contacts; side plate parts extending from side edges of the L-shaped part to cover side surfaces of each C-shaped part; a fitted part extending inward from an upper end of the side plate parts facing the support conductor to fit a small diameter part formed in the support conductor; and a snap-fit part engaged with a protrusion formed on a lower surface of a lower plate part of each C-shaped part.

According to this configuration, when fixing the insulation cover to the C-shaped part of each fixed contact, the insulation cover can be fixed at the two sections, the fitted part and the snap-fit part. Accordingly, the insulation cover can reliably be prevented from falling out while being installed in the C-shaped part.

According to the present invention, the fixed contacts can easily be attached easily to the tub-shaped arc-extinguishing chamber having one end being open, and the insulation cover can be installed easily in the C-shaped parts of the fixed contacts in a narrow space. Therefore, the arc-extinguishing chamber can be assembled easily.

BRIEF DESCRIPTION OF THE DRAWINGS

FIGS. 9(*a*)-9(*d*) are perspective views showing a method for installing the insulation cover shown in FIG. 8.

BEST MODE FOR CARRYING OUT THE INVENTION

Embodiments of the present invention are described hereinafter with reference to the drawings.

Figure 1:
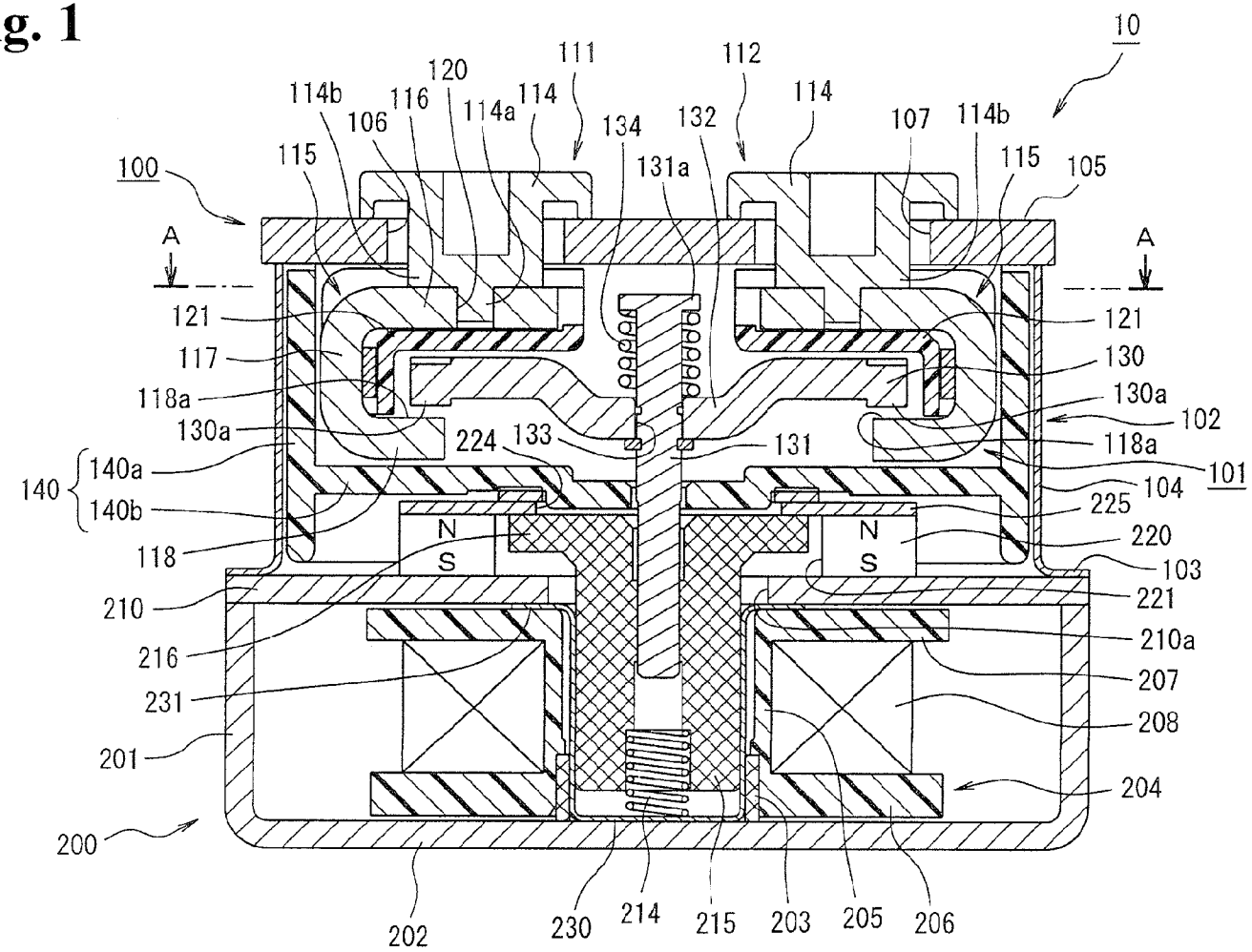
FIG. 1 is a cross-sectional diagram showing a first embodiment of an electromagnetic contactor according to the present invention.
Figure 2B:
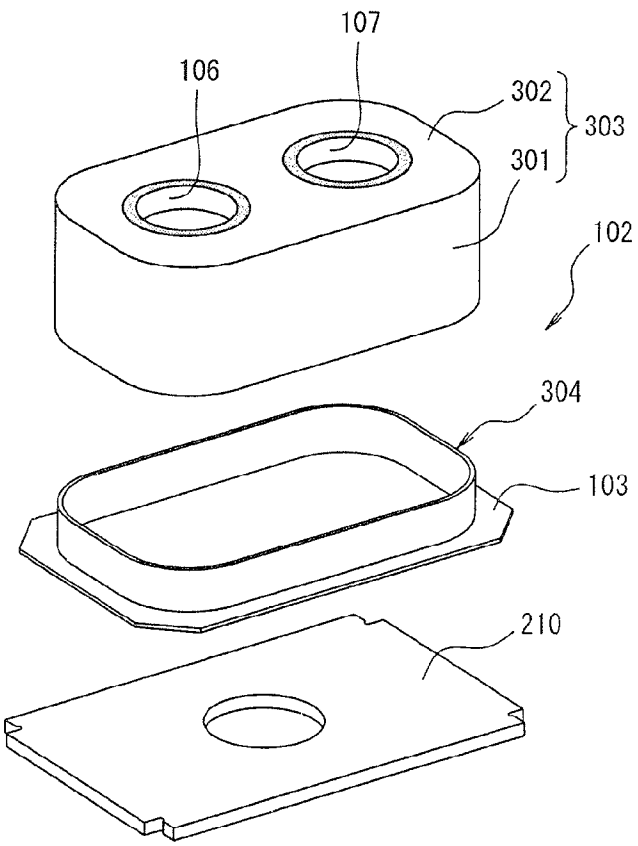
FIGS. 2(*a*), 2(*b*) are exploded perspective views of an arc-extinguishing chamber.
Figure 2A:
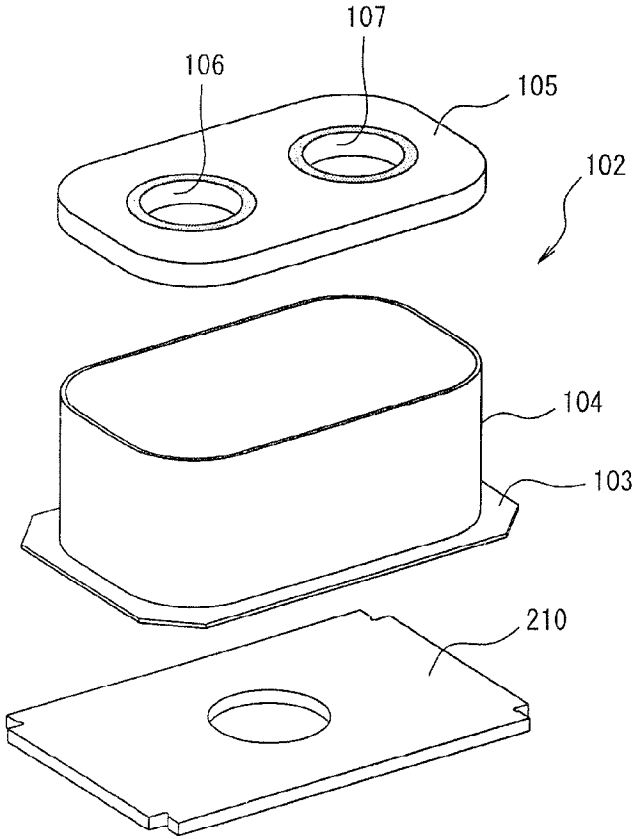

FIG. 1 is a cross-sectional diagram showing an example of an electromagnetic switch according to the present invention. FIGS. 2(*a*), 2(*b*) are exploded perspective views of an arc-extinguishing chamber. Reference numeral 10 shown in FIGS. 1 and 2(*a*), 2(*b*) represents an electromagnetic contactor. The electromagnetic contactor 10 is configured by a contact point device 100 in which a contact point mechanism is disposed, and an electromagnetic unit 200 that drives the contact point device 100.

As is clear from FIGS. 1 and 2(*a*), 2(*b*), the contact point device 100 has an arc-extinguishing chamber 102 for storing a contact point mechanism 101 therein. As shown in FIG. 2(*a*), this arc-extinguishing chamber 102 has an angular cylindrical body 104 having an outwardly protruding flange part 103 at a metallic lower end part thereof, and a fixed contact point supporting insulating substrate 105, configured with a flat ceramic insulating substrate, for sealing an upper end of the angular cylindrical body 104.

The angular cylindrical body 104 has its flange part 103 seal-bonded and fixed to an upper magnetic yoke 210 of the electromagnetic unit 200, which is described hereinafter.

The fixed contact point supporting insulating substrate 105 has, at a central part thereof, through-holes 106, 107 disposed at a predetermined interval to allow a pair of fixed contacts 111, 112 to be inserted thereto, the pair of fixed contacts 111, 112 being described hereinafter. The periphery of the through-holes 106, 107 formed on an upper surface of the fixed contact point supporting insulating substrate 105 and a position on a lower surface of the fixed contact point supporting insulating substrate 105 that contacts the angular cylindrical body 104 are metalized. This metallization is done by forming metal foil (e.g., copper foil) in the periphery of the through-holes 106 and 107 and the position contacting the angular cylindrical body 104, while arranging the plurality of fixed contact point supporting insulating substrates 105 in a matrix in a plane.

As shown in FIG. 1, the contact point mechanism 101 has the pair of fixed contacts 111, 112 that is inserted into and fixed to the through-holes 106, 107 of the fixed contact point supporting insulating substrate 105 of the arc-extinguishing chamber 102. Each of the fixed contacts 111, 112 has a support conductor 114 that is inserted into the through-hole 106 or 107 of the fixed contact point supporting insulating substrate 105 and has an outwardly protruding flange part at its upper end, and a C-shaped part 115 that is coupled to the support conductor 114, placed on the lower-surface side of the fixed contact point supporting insulating substrate 105, and has an open inner side.

The C-shaped part 115 has an upper plate part 116 extending outward along the lower surface of the fixed contact point supporting insulating substrate 105, an intermediate plate part 117 extending downward from an outer end part of the upper plate part 116, and a lower plate part 118 extending inward from a lower end of the intermediate plate part 117 to be parallel with the upper plate part 116 and to face the fixed contacts 111, 112. The C-shaped part 115 is so formed by adding the upper plate part 116 to the L-shape formed by the intermediate plate part 117 and the lower plate part 118.

The support conductor 114 and the C-shaped part 115 are, for example, brazed and fixed to each other by inserting a pin 114*a* of the support conductor 114 into a through-hole 120 formed on the upper plate part 116 of the C-shaped part 115, the pin 114*a* being formed in a protruding manner on a lower end surface of the support conductor 114. The support conductor 114 and the C-shaped part 115 may be fixed not only by brazing processing but also by fitting the pin 114*a* and the through-hole 120 together or by forming a male screw on the pin 114*a*, forming a female screw on the through-hole 120, and then screwing them together.

A synthetic-resin insulation cover 121 for restricting generation of an arc is installed in each of the C-shaped parts 115 of the fixed contacts 111, 112. This insulation cover 121 covers inner circumferential surfaces of the upper plate part 116 and the intermediate plate part 117 of the C-shaped part 115, as shown in FIGS. 3(*a*), 3(*b*).

The insulation cover 121 has an L-shaped plate part 122 formed along the inner circumferential surfaces of the upper plate part 116 and the intermediate plate part 117, side plate parts 123, 124 that extend upward and outward from front and rear end parts of the L-shaped plate part 122 to cover side surfaces of the upper plate part 116 and the intermediate plate part 117 of the C-shaped part 115, and fitted parts 125 that extend inward from upper ends of the side plate parts 123, 124 to be fitted to a small diameter part 114*b* formed in each of the support conductor 114 of the fixed contacts 111, 112.

Figure 3A:
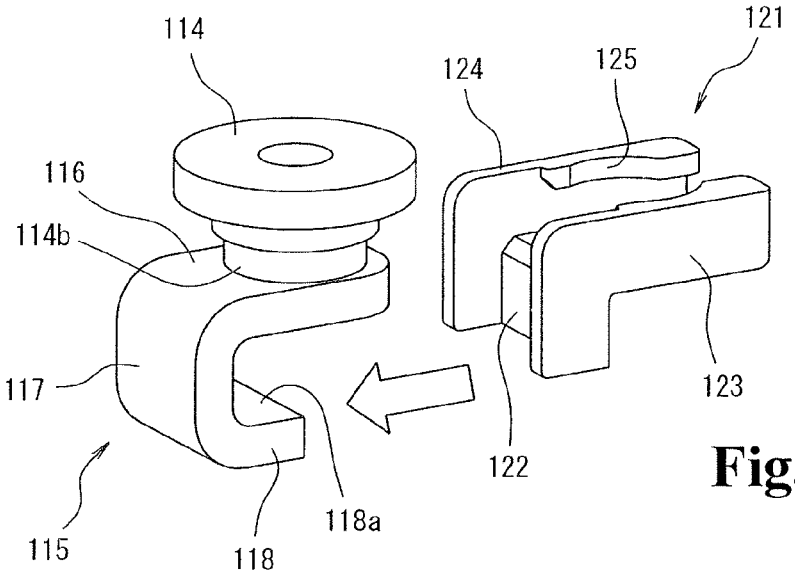
FIGS. 3(*a*)-3(*c*) show diagrams of an insulation cover of a contact point mechanism, wherein FIG. 3(*a*) is a perspective view, FIG. 3(*b*) is a plan view showing a state prior to installment, and FIG. 3(*c*) is a plan view showing a state after installment.
Figure 3B:
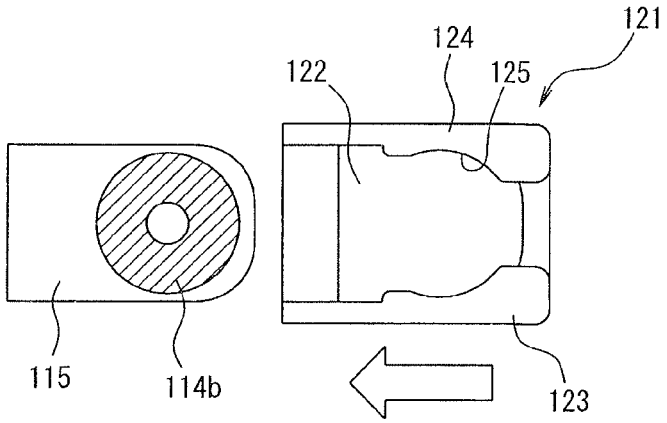
Figure 3C:
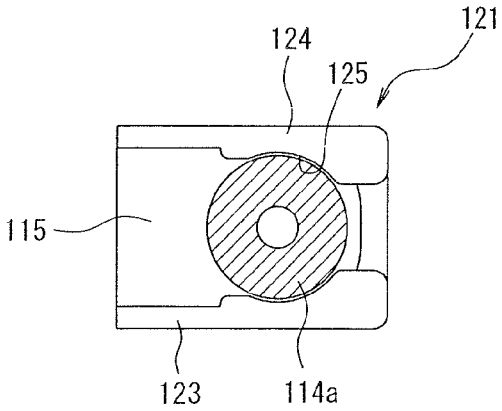

Therefore, the fitted parts 125 are positioned to face the small diameter part of each support conductor 114 of the fixed contacts 111, 112 as shown in FIGS. 3(*a*), 3(*b*), and then the insulation cover 121 is pushed so that the fitted parts 125 are fitted in the small diameter part 114*b* of the support conductor 114, as shown in FIG. 3(*c*).

Figure 4A:
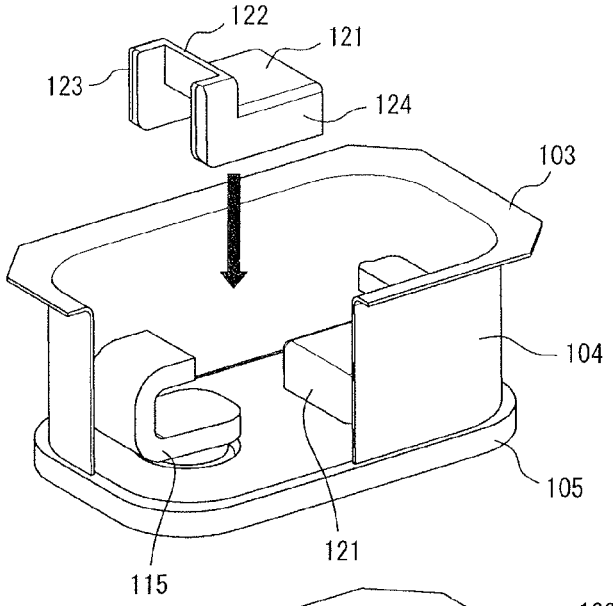
FIGS. 4(*a*)-4(*c*) are perspective views showing a method for installing the insulation cover.
Figure 4B:
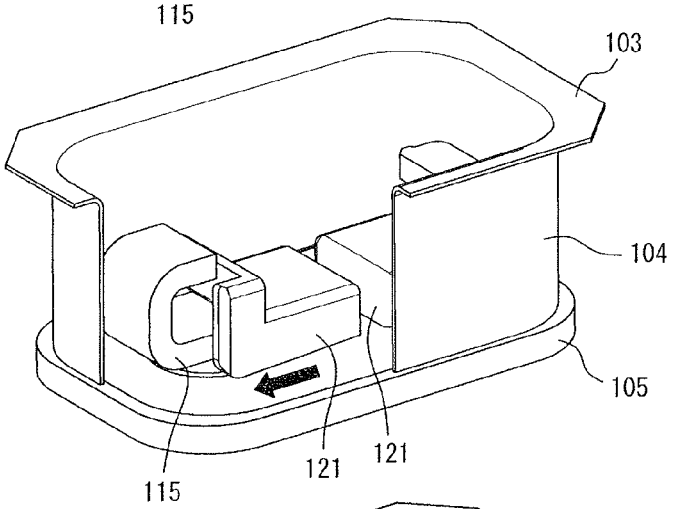
Figure 4C:
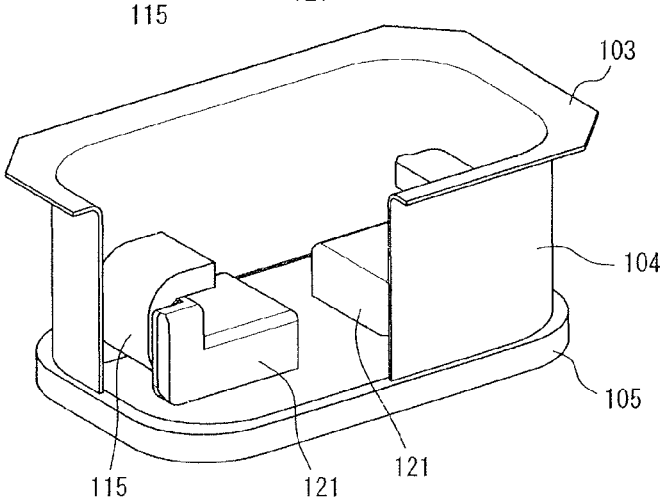

Practically, the arc-extinguishing chamber 102 with the fixed contacts 111, 112 attached thereto is inserted between the fixed contacts 111, 112, with the fixed contact point supporting insulating substrate 105 kept down and the insulation cover 121, which is flipped from the state shown in FIGS. 3(*a*) to 3(*c*), placed in an upper opening part of the angular cylindrical body 104, as shown in FIG. 4(*a*).

Subsequently, while the fitted parts 125 are contacting the fixed contact point supporting insulating substrate 105 as shown in FIG. 4(*b*), the insulation cover 121 is pushed outward, allowing the fitted parts 125 to fit in the small diameter part 114*b* of the support conductor 114 of each of the fixed contacts 111, 112, as shown in FIG. 4(*c*).

By installing the insulation cover 121 in the C-shaped part 115 of each of the fixed contacts 111, 112 as described above, only an upper surface of the lower plate part 118 is exposed on an inner circumferential surface of the C-shaped part 115, forming a contact point part 118*a*.

Figure 5:
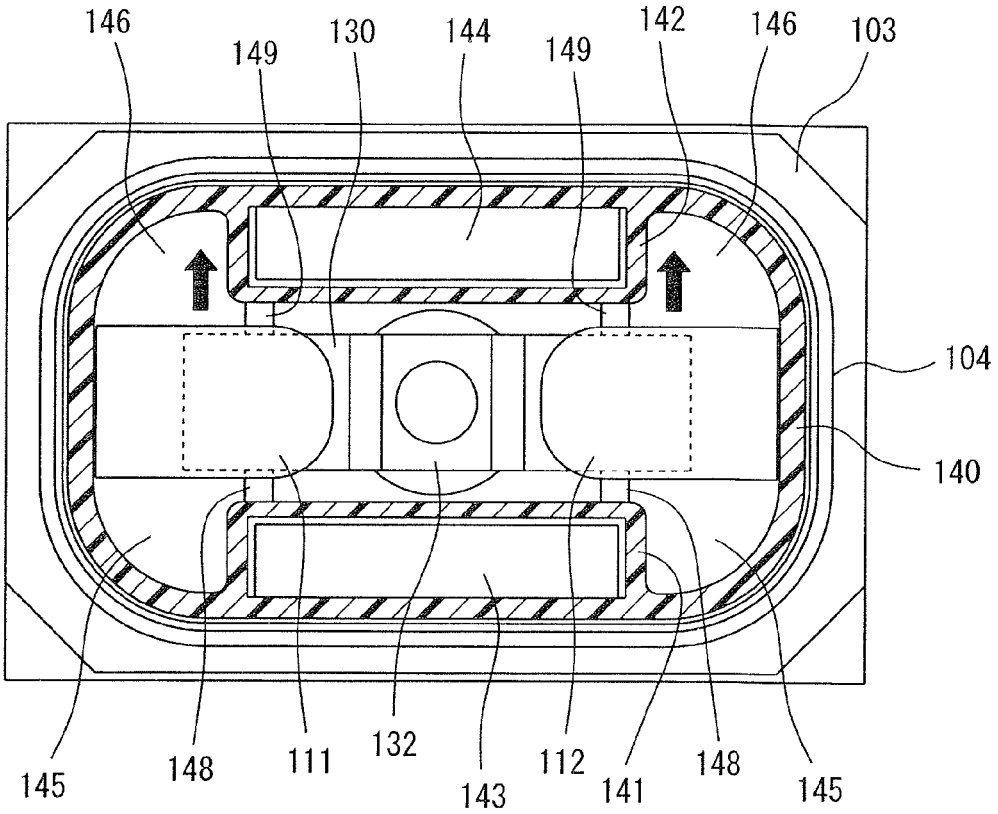
FIG. 5 is a cross-sectional diagram taken along line A-A shown in FIG. 1.

A movable contact 130 is placed in the C-shaped part 115 of the fixed contacts 111, 112 such that either end part thereof is disposed. This movable contact 130 is supported by a coupling shaft 131 fixed to a movable plunger 215 of the electromagnetic unit 200, the movable plunger 215 being described hereinafter. As shown in FIGS. 1 and 5, the movable contact 130 has a concave part 132 formed by causing the vicinity of the coupling shaft 131 in the middle to protrude downward, and a through-hole 133 through which the coupling shaft 131 is inserted into the concave part 132.

A flange part 131*a* that protrudes outward is formed at an upper end of the coupling shaft 131. A lower end of the coupling shaft 131 is inserted into a contact spring 134, and the through-hole 133 is pierced in the movable contact 130. An upper end of the contact spring 134 abuts against the flange part 131*a*, and thereby the movable contact 130 is positioned using, for example, a C-ring 135 so as to obtain a predetermined urging force of the contact spring 134.

This movable contact 130 is in an open state when a contact point part 130*a* on either end thereof and the contact point part 118*a* of the lower plate part 118 of the C-shaped part 115 of each of the fixed contacts 111, 112 are separated from each other with a predetermined interval therebetween. The movable contact 130 is in a closed state when the contact point part on either end thereof contacts the contact point part 118*a* of the lower plate part 118 of the C-shaped part 115 of the fixed contacts 111, 112 by a predetermined contact pressure of the contact spring 134.

As shown in FIGS. 1 and 5, an insulating cylindrical body 140 is placed on an inner circumferential surface of the angular cylindrical body 104 of the arc-extinguishing chamber 102, the insulating cylindrical body 140 being formed into a bottomed angular cylindrical body with an angular cylindrical part 140*a* and a bottom plate part 140*b* formed on a lower surface of the angular cylindrical part 140*a*. The insulating cylindrical body 140 is obtained by integrally molding the angular cylindrical part 140*a* and the bottom plate part 140*b* with synthetic resin. Magnetic storage cylindrical bodies 141, 142 functioning as magnetic storage units are integrally formed in a position of the insulating cylindrical body 140 that faces a side surface of the movable contact 130. Permanent magnets for arc extinguishing 143, 144 are inserted through the magnetic storage cylindrical bodies 141, 142, thereby fixing the magnetic storage cylindrical bodies 141, 142.

The permanent magnets for arc extinguishing 143, 144 are magnetized such that their magnetic pole surfaces facing each other have the same polarity, such as the N pole, in a thickness direction. As shown in FIG. 5, in each of the permanent magnets for arc extinguishing 143, 144, its end parts in a lateral direction is positioned slightly inward from the position where the contact point part 118*a* of each of the fixed contacts 111, 112 and the contact point part of the movable contact 130 face each other. Arc-extinguishing spaces 145, 146 are formed on the outside of each of the magnetic storage cylindrical bodies 141, 142 in the lateral direction, that is, in the longitudinal direction of the movable contact.

Movable contact guide members 148, 149 are formed in a protruding manner. The movable contact guide members 148, 149 slide contacting side edges of the magnetic storage cylindrical bodies 141, 142 that are located near ends of the movable contact 130, to restrict a turning motion of the movable contact 130.

The insulating cylindrical body 140, therefore, functions to determine the positions of the permanent magnets for arc extinguishing 143, 144 based on the magnetic storage cylindrical bodies 141, 142, to protect the permanent magnets for arc extinguishing 143, 144 from an arc, and to block the effect of an arc onto the metallic angular cylindrical body 104 that increases the rigidity on the outside.

The permanent magnets for arc extinguishing 143, 144 can be brought close to the movable contact 130 by disposing the permanent magnets for arc extinguishing 143, 144 on the inner circumferential surfaces of the insulating cylindrical body 140. Therefore, magnetic fluxes ϕ that are generated from the N poles of the permanent magnets for arc extinguishing 143, 144 pass across the part where the contact point part 118*a* of the fixed contacts 111, 112 and the contact point part 130*a* of the movable contact 130 face each other, from the inside to the outside in the lateral direction, at a large magnetic flux density, as shown in FIG. 6(*a*).

Figure 6A:
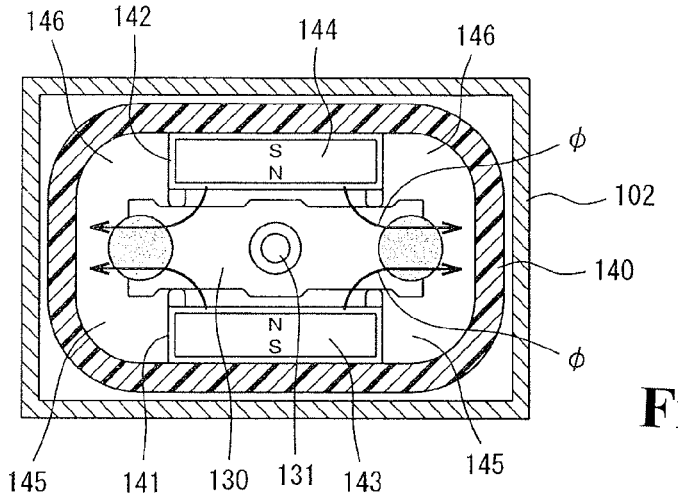
FIGS. 6(*a*)-6(*c*) are explanatory diagrams illustrating arc extinguishing performed by a permanent magnet for arc extinguishing according to the present invention.
Figure 6B:
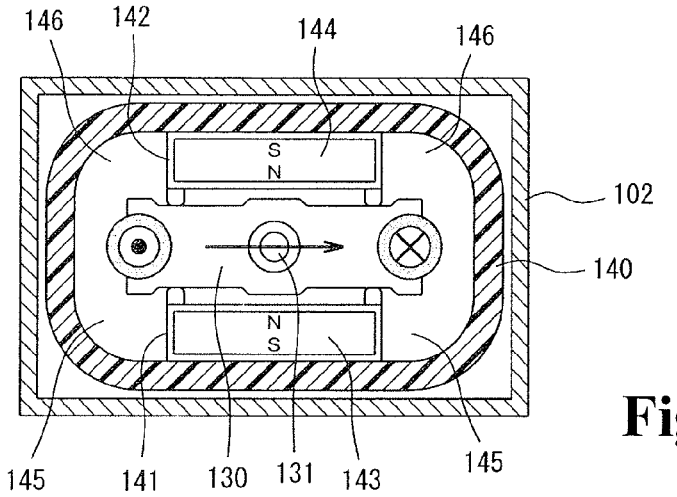
Figure 6C:
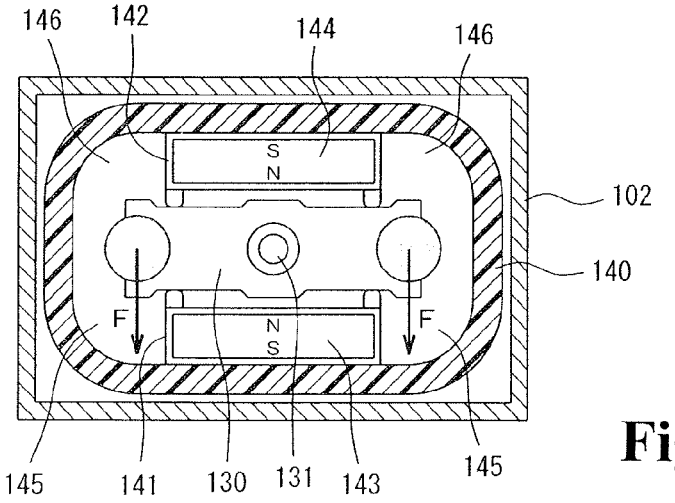

Therefore, when connecting the fixed contact 111 to a current supply source and the fixed contact 112 to the load side, a current flows from the fixed contact 111 to the fixed contact 112 through the movable contact 130 during the closed state, as shown FIG. 6(*b*). When the closed stare is changed to the open state in which the movable contact 130 is moved upward away from the fixed contacts 111, 112, an arc is generated between the contact point part 118*a* of each of the fixed contacts 111, 112 and the contact point part 130*a* of the movable contact 130.

As shown in FIG. 6(*c*), this arc is stretched to the arc-extinguishing space 145 on the permanent magnet for arc extinguishing 143 side, due to the magnetic fluxes ϕ generated from the permanent magnets for arc extinguishing 143, 144. At this moment, because the arc-extinguishing spaces 145, 146 are formed to be as wide as the thickness of the permanent magnets for arc extinguishing 143, 144, a long arc can be obtained, thereby extinguishing the arc reliably.

Figure 7A:
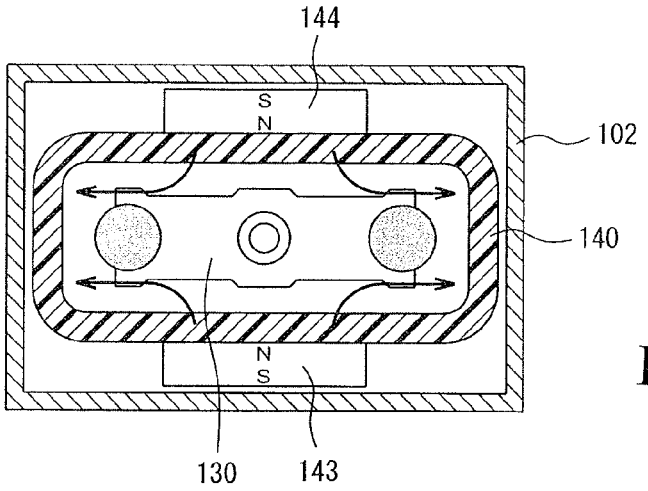
FIGS. 7(*a*)-7(*c*) are explanatory diagrams illustrating arc extinguishing performed when the permanent magnet for arc extinguishing is disposed outside an insulation case.
Figure 7B:
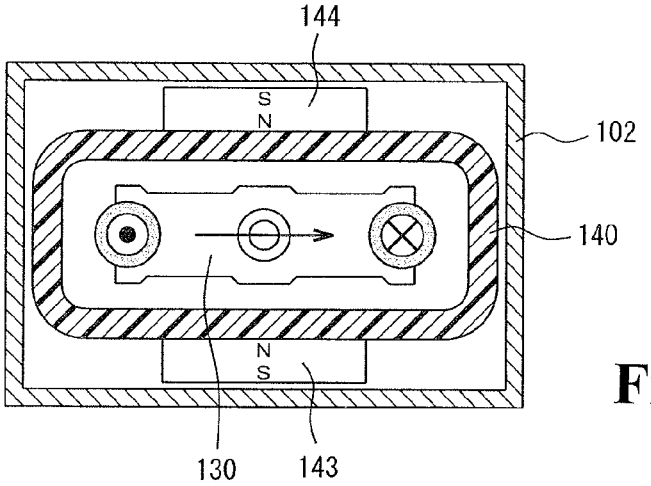
Figure 7C:
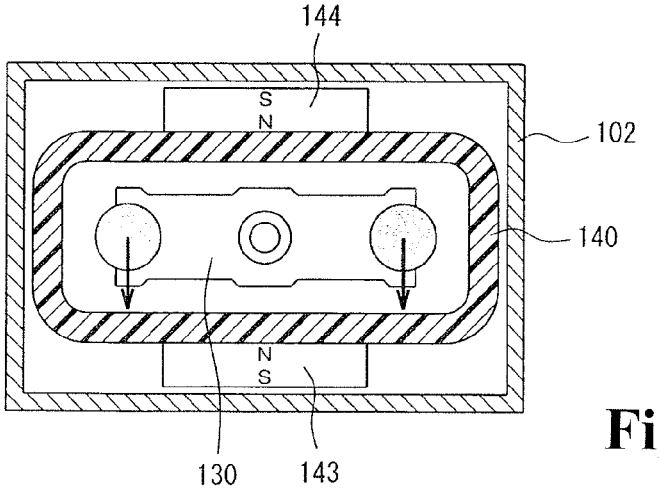

Incidentally, disposing the permanent magnets for arc extinguishing 143, 144 outside the insulating cylindrical body 140 as shown in FIGS. 7(*a*) to 7(*c*) increases the distance between each of the permanent magnets for arc extinguishing 143, 144 and the position where the contact point part 118*a* of each of the fixed contacts 111, 112 and the contact point part 130*a* of the movable contact 130 face each other, reducing the magnetic flux density of the magnetic flux passing across the arc when permanent magnets same as those of the present embodiment are applied.

This consequently reduces the Lorentz force that acts on the arc generated when the closed state is changed to the open state. As a result, the arc cannot be stretched sufficiently. The level of magnetization between the permanent magnets for arc extinguishing 143, 144 needs to be increased in order to improve the ability to extinguish the arc. Moreover, the width of the insulating cylindrical body 140 in a front-back direction needs to be narrowed in order to reduce the distance between each of the permanent magnets for arc extinguishing 143, 144 and the contact point part of the movable contact 130 of the fixed contacts 111, 112. However, doing so cannot secure a sufficient arc-extinguishing space for extinguishing the arc.

According to this embodiment, however, because the permanent magnets for arc extinguishing 143, 144 are disposed on the inside of the insulating cylindrical body 140, the problems that are generated as a result of disposing the permanent magnets for arc extinguishing 143, 144 on the outside of the insulating cylindrical body 140 can be solved completely.

The electromagnetic unit 200 has a U-shaped magnetic yoke 201 that is flat when viewed from the side, and has a tubular auxiliary yoke 203 fixed at a central part of a bottom plate part 202 of the magnetic yoke 201, as shown in FIG. 1. A spool 204 is disposed on the outside of the tubular auxiliary yoke 203.

This spool 204 is configured by a central tubular part 205 into which the tubular auxiliary yoke 203 is inserted, a lower flange part 206 that protrudes radially outward from a lower end part of the central tubular part 205, and an upper flange part 207 that protrudes radially outward from a section slightly below an upper end of the central tubular part 205. An exciting coil 208 is wrapped in a storage space configured by the central tubular part 205, the lower flange part 206, and the upper flange part 207.

An upper magnetic yoke 210 is fixed between upper ends of the magnetic yoke 201 that are opened. At a central part of the upper magnetic yoke 210, a through-hole 210*a* is formed facing the central tubular part 205 of the spool 204.

The movable plunger 215 is placed slidably in the central tubular part 205 of the spool 204 to be slidable vertically, the movable plunger 215 having a return spring 214 placed between a bottom part thereof and the bottom plate part 202 of the magnetic yoke 201. A peripheral flange part 216 that protrudes radially outward is formed at an upper end part of the movable plunger 215, which protrudes upward from the upper magnetic yoke 210.

An annular permanent magnet 220 that has, for example, a square outer shape and a circular central opening 211 is fixed to an upper surface of the upper magnetic yoke 210 so as to surround the peripheral flange part 216 of the movable plunger 215. The permanent magnet 220 is magnetized, with its upper end configured as, for example, the N pole and lower end as the S pole in terms of its vertical direction or thickness direction. Note that the shape of the central opening 211 of the permanent magnet 220 matches the shape of the peripheral flange part 216 and that an outer circumferential surface of the through-hole 221 can be formed into a circular, square or any shape.

An auxiliary yoke 225 is fixed to an upper end surface of the permanent magnet 220. The auxiliary yoke 225 has the same shape as the permanent magnet 220 and has a through-hole 224 whose inner diameter is smaller than an outer diameter of the peripheral flange part 216 of the movable plunger 215. The peripheral flange part 216 of the movable plunger 215 abuts against a lower surface of the auxiliary yoke 225.

Note that the shape of the permanent magnet 220 is not limited to the shape described above and therefore can be formed into a ring or any shape as long as the inner circumferential surface thereof forms a tubular surface.

The coupling shaft 131 supporting the movable contact 130 is screwed to an upper end surface of the movable plunger 215.

The movable plunger 215 is covered with a non-magnetic cap 230 in the shape of a cylinder with a bottom, and a flange part 231 that extends radially outward to an open end of the cap 230 is seal-bonded to a lower surface of the upper magnetic yoke 210. This configuration forms an airtight container in which the arc-extinguishing chamber 102 and the cap 230 are communicated to each other via the through-hole 210*a* of the upper magnetic yoke 210. This airtight container formed by the arc-extinguishing chamber 102 and the cap 230 is filled with hydrogen gas, nitrogen gas, mixed gas of hydrogen and nitrogen, air, $SF_6$, or other type of gas.

Operations of the present embodiment are described next.

When assembling the arc-extinguishing chamber 102, first, the support conductor 114 of the fixed contacts 111, 112 is inserted from above into the through-hole 106, 107 of the fixed contact point supporting insulating substrate 105. Next, the C-shaped part 115 is fitted to the lower surface side of the fixed contact point supporting insulating substrate 105 so as to fit the pin 114*a* of the support conductor 114 into the through-hole 120.

In this state, the fixed contact point supporting insulating substrate 105, the metallic angular cylindrical body 104 and the fixed contacts 111, 112 are fixed using a brazing jig and brazed in a furnace. Accordingly, brazing of the fixed contacts 111, 112 to the fixed contact point supporting insulating substrate 105 and brazing of the metallic angular cylindrical body 104 to the fixed contact point supporting insulating substrate 105 are performed at the same time to form the arc-extinguishing chamber 102.

Subsequently, as shown in FIG. 4(*a*), the arc-extinguishing chamber 102 is flipped, with the opening end of the arc-extinguishing chamber 102 facing up. In this state, the insulation cover 121, with its fitted part 125 facing the fixed contact point part supporting insulating substrate 105, is inserted into the arc-extinguishing chamber 102. Then, as shown in FIG. 4(*b*), the fitted part 125 of the insulation cover 121 contacts a rear surface of the fixed contact point supporting insulating substrate 105, and the fitted part 125 faces the small diameter part 114*b* of the support conductor 114 of the fixed contact 111.

In this state, the insulation cover 121 pressed outward to fit the fitted part 125 to the small diameter part 114*b* of the support conductor 114. As a result, the insulation cover 121 can be installed in the C-shaped part 115 of the fixed contact 111.

In the same manner, the insulation cover 121 is installed in the fixed contact 112.

By simply bringing the fitted part 125 of the insulation cover 121 to contact the back surface of the fixed contact point supporting insulating substrate 105 and then pushing the insulation cover 121 outward, the insulation cover 121 can be installed in the C-shaped part 115 of the fixed contacts 111, 112 in a narrow space of the arc-extinguishing chamber 102.

Thereafter, the movable contact 130 and the coupling shaft 131 installed with the contact spring 134 are disposed such that both ends of the movable contact 130 are positioned within the C-shaped parts 115 of the fixed contacts 111, 112. Finally, the arc-extinguishing chamber 102 equipped with the contact point mechanism 101 therein is formed by inserting the insulating cylindrical body 140 into the inner circumferential surface of the metallic angular cylindrical body 104.

According to the configuration described above, when applying the fixed contacts 111, 112 having a complicated shape, the arc-extinguishing chamber 102 can be assembled easily. Moreover, because the sections other than the contact point part 118*a* of the C-shaped part 115 of the fixed contacts 111, 112 are covered with the insulation cover 121, a predetermined insulation distance can be obtained even when the upper plate part 116 of the C-shaped part 115 is brought close to the movable contact 130, reducing the height of the movable contact 130 of the contact point mechanism 101 in the height direction and the size of the contact point device 100.

Subsequently, the electromagnetic contact 10 can be assembled by attaching the electromagnetic unit 200 to the contact point device 100.

Next are described operations performed when, for example, connecting the fixed contact 111 of the electromagnetic contactor 10 that is assembled as described above, to a power supply source for supplying large current and when the fixed contact 112 is connected to a load.

Suppose, in this state, that the exciting coil 208 of the electromagnetic unit 200 is in a non-excited state, or the open state in which no excitation force for lowering the movable plunger 215 in the electromagnetic unit 200 is generated. In this open state, the movable plunger 215 is urged upward by the return spring 214 to separate from the upper magnetic yoke 210. At the same time, the attractive force that is generated from the magnetic force of the permanent magnet 220 acts on the auxiliary yoke 225 to attract the peripheral flange part 216 of the movable plunger 215. Consequently, the upper surface of the peripheral flange part 216 of the movable plunger 215 abuts against the lower surface of the auxiliary yoke 225.

Thus, the contact point part 130*a* of the movable contact 130 of the contact point mechanism 101, which is coupled to the movable plunger 215 by the coupling shaft 131, is moved upward away from the contact point part 118*a* of each of the fixed contacts 111, 112 by a predetermined distance. As a result, the current path between the fixed contacts 111, 112 enters the interruption state, and the contact point mechanism 101 enters an open pole state.

In the open state, because both the urging force of the return spring 214 and the attractive force of the annular permanent magnet 220 act on the movable plunger 215, malfunctions can reliably be prevented without carelessly allowing the movable plunger 215 to be dropped by external vibration or impact.

When the exciting coil 208 of the electromagnetic unit 200 is excited in this open state, the excitation force is generated in the electromagnetic unit 200, pushing the movable plunger 215 down against the urging force of the return spring 214 and the attractive force of the annular permanent magnet 220.

After the lower surface of the peripheral flange part 216 abuts against the upper surface upper magnetic yoke 210, the dropping movable plunger 215 is stopped.

As a result of dropping the movable plunger 215, the movable contact 130 that is coupled to the movable plunger 215 by the coupling shaft 131 is also dropped, whereby the contact point part 130*a* contacts the contact point part 118*a* of each of the fixed contacts 111, 112 by the contact pressure of the contact spring 134.

As a result, a closed pole state is established in which a large current of the external power supply source is supplied to the load through the fixed contact 111, the movable contact 130, and the fixed contact 112.

At this moment, electromagnetic repulsive force acting in a direction of opening the movable contact 130 is generated between the movable contact 130 and the fixed contacts 111, 112.

However, because the C-shaped part 115 is formed by the upper plate part 116, the intermediate plate part 117, and the lower plate part 118 in each of the fixed contacts 111, 112, as shown in FIG. 1, the directions of current flowing in the upper plate part 116 and the lower plate part 118 become opposite to the direction of current flowing in the movable contact 130 facing the upper plate part 116 and the lower plate part 118. Therefore, according to the relationship between a magnetic field formed by the lower plate parts 118 of each of the fixed contacts 111, 112 and the current flowing in the movable contact 130, the Lorentz force that presses the movable contact 130 against the contact point part 118*a* of each of the fixed contacts 111, 112 can be generated based on the Fleming's left-hand rule.

This Lorentz force can act against the electromagnetic repulsive force in the open pole direction that is generated between the contact point part 118*a* of each of the fixed contacts 111, 112 and the contact point part 130*a* of the movable contact 130, reliably preventing the contact point part 130*a* of the movable contact 130 from opening. As a result, pressing force of the contact spring 134 supporting the movable contact 130 can be reduced. Accordingly, a thrust that is generated in the exciting coil 208 can be lowered, reducing the size of the configuration of the entire electromagnetic contactor.

When shutting off the supply of current to the load in the closed pole state of the contact point mechanism 101, excitation of the exciting coil 208 of the electromagnetic unit 200 is stopped.

As a result, the exciting force for moving the movable plunger 215 of the electromagnetic unit 200 downward disappears. Consequently, the attractive force of the annular permanent magnet 220 increases as the movable plunger 215 is lifted up by the urging force of the return spring 214 and the peripheral flange part 216 approaches the auxiliary yoke 225.

As a result of lifting up the movable plunger 215, the movable contact 130, which is coupled the movable plunger 215 by the coupling shaft 131, is lifted up. In response to this action, the movable contact 130 contacts the fixed contacts 111, 112, while the contact pressure is applied thereto by the contact spring 134. Subsequently, as soon as the contact pressure of the contact spring 134 disappears, an open pole starting state is set in which the movable contact 130 moves upward to separate from the fixed contacts 111, 112.

Once this open pole starting state begins, an arc is generated between the contact point part 118*a* of each of the fixed contacts 111, 112 and the contact point part 130*a* of the movable contact 130, and the current is constantly applied by the arc. At this moment, due to the installed the insulation cover 121 for covering the upper plate part 116 and the intermediate plate part 117 of the C-shaped part 115 of each of the fixed contacts 111, 112, an arc can be generated only between the contact point part 118*a* of each of the fixed contacts 111, 112 and the contact point part 130*a* of the movable contact 130. Therefore, the arc can be reliably prevented from moving on the C-shaped part 115 of the fixed contacts 111, 112 and can be generated stably, improving the ability of extinguishing the arc. Moreover, because the side surfaces of the fixed contacts 111, 112 are covered with the insulation cover 121, the tip end of the arc can be prevented from shorting.

The insulation cover 121 can be installed in the fixed contacts 111, 112 by simply fitting the fitted part 125 to the small diameter part 114*b* of the fixed contacts 111, 112. Thus, the insulation cover 121 can easily be installed in the fixed contacts 111, 112.

Moreover, because the pole faces of the permanent magnets for arc-extinguishing 143, 144 that face each other are the N poles and the faces on the other side are the S poles, the magnetic fluxes that are generated from the N poles pass across an arc generation part of the part where the contact point part 118*a* of the fixed contact 111 and the contact point part 130*a* of the movable contact 130 face each other, from the inside to the outside in a longitudinal direction of the movable contact 130, and reach the S poles, as shown in the plan view in FIG. 6(*a*), thereby forming a magnetic field. Similarly, the magnetic fluxes pass across an arc generation part between the contact point part 118*a* of the fixed contact 112 and the contact point part 130*a* of the movable contact 130, from the inside to the outside in the longitudinal direction of the movable contact 130, and reach the S poles, thereby forming a magnetic field.

Therefore, the magnetic fluxes of the permanent magnets for arc extinguishing 143, 144 pass across the part between the contact point part 118*a* of the fixed contact 111 and the contact point part 130*a* of the movable contact 130 and the part between the contact point part 118*a* of the fixed contact 112 and the contact point part 130*a* of the movable contact 130 in directions opposite to each other in the longitudinal direction of the movable contact 130.

Thus, between the contact point part 118*a* of the fixed contact 111 and the contact point part 130*a* of the movable contact 130, current I flows from the fixed contact 111 side to the movable contact 130 side, as shown in FIG. 6(*b*), and the magnetic flux $\phi$ is directed from the inside to the outside. As a result, large Lorentz force F is generated based on the Fleming's left-hand rule to act toward the arc-extinguishing space 145 in a direction perpendicular to the longitudinal direction of the movable contact 130 and an opening/closing direction of the contact point part 118*a* of the fixed contact 111 and the movable contact 130, as shown in FIG. 6(*c*).

The arc that is generated between the contact point part 118*a* of the fixed contact 111 and the contact point part 130*a* of the movable contact 130 is stretched significantly so as to reach an upper surface of the movable contact 130 from a side surface of the contact point part 118*a* of the fixed contact 111 through the arc-extinguishing space 145 and extinguished by this Lorentz force F.

In the arc-extinguishing space 145, the magnetic flux is inclined toward the lower side and the upper side with respect to the direction of the magnetic flux between the contact point part 118*a* of the fixed contact 111 and the contact point part 130*a* of the movable contact 130. Therefore, the arc that is stretched to the arc-extinguishing space 145 can be further stretched to the corners of the arc-extinguishing space 145 and lengthened by the inclined magnetic flux, realizing favorable interruption performance.

Between the contact point part 118*a* of the fixed contact 112 and the movable contact 130, on the other hand, the current flows from the movable contact 130 side to the fixed contact 112 side, and the magnetic flux $\phi$ is directed to the right, i.e., from the inside to the outside, as shown in FIG. 6(*b*). As a result, large Lorentz force F is generated based on the Fleming's left-hand rule to act toward the arc-extinguishing space 145 in a direction perpendicular to the longitudinal direction of the movable contact 130 and an opening/closing direction of the contact point part 118*a* of the fixed contact 112 and the movable contact 130.

The arc that is generated between the contact point part 118*a* of the fixed contact 112 and the movable contact 130 is stretched significantly so as to reach a side surface of the fixed contact 112 from the upper surface of the movable contact 130 through the arc-extinguishing space 145 and extinguished by this Lorentz force F.

In the arc-extinguishing space 145, as described above, the magnetic flux is inclined toward the lower side and the upper side with respect to the direction of the magnetic flux between the contact point part 118*a* of the fixed contact 112 and the contact point part 130*a* of the movable contact 130.

Therefore, the arc that is stretched to the arc-extinguishing space 145 can be further stretched to the corners of the arc-extinguishing space 145 and lengthened by the inclined magnetic flux, realizing favorable interruption performance.

On the other hand, when changing the state of the electromagnetic contactor 10 to the open state from the closed state where a regenerative current flows from the load to a DC power source, the direction of the current inverts, as shown in FIG. 6(*b*). Therefore, the same arc extinguishing function is exerted, except that Lorentz force F acts on the arc-extinguishing space 146 and that the arc is stretched toward the arc-extinguishing space 146.

Because the permanent magnets for arc extinguishing 143, 144 are disposed in the magnetic storage cylindrical bodies 141, 142 formed in the insulating cylindrical body 140, the arc does not directly contact the permanent magnets for arc extinguishing 143, 144. For this reason, the magnetic characteristics of the permanent magnets for arc extinguishing 143, 144 can be maintained stably, stabilizing the interruption performance.

Furthermore, because the inner circumferential surface of the arc-extinguishing chamber 102 can be covered and insulated by the insulating cylindrical body 140, the arc can be prevented from shorting during current interruption. Thus, the current interruption can be achieved reliably.

Moreover, the single insulating cylindrical body 140 can function to insulate, determine the positions of the permanent magnets for arc extinguishing 143, 144, protect the permanent magnets 143, 144 from an arc, and prevent the arc from reaching the metallic angular cylindrical body 104 on the outside, reducing the production costs.

The distance between the side edge of the movable contact 130 and the inner circumferential surface of the insulating cylindrical body 140 can be increased by the thickness of each of the permanent magnets for arc extinguishing 143, 144. Therefore, sufficient arc-extinguishing spaces 145, 146 can be provided, and the arc can reliably be extinguished.

The movable contact 130 can reliably be prevented from turning, because the movable contact guide members 148, 149 that slidably contact the side edge of the movable contact are formed in a protruding manner at the positions of the magnetic storage cylindrical bodies 141, 142 that face the movable contact 130, the magnetic storage cylindrical bodies 141, 142 storing the permanent magnets for arc extinguishing 143, 144.

Figure 8:
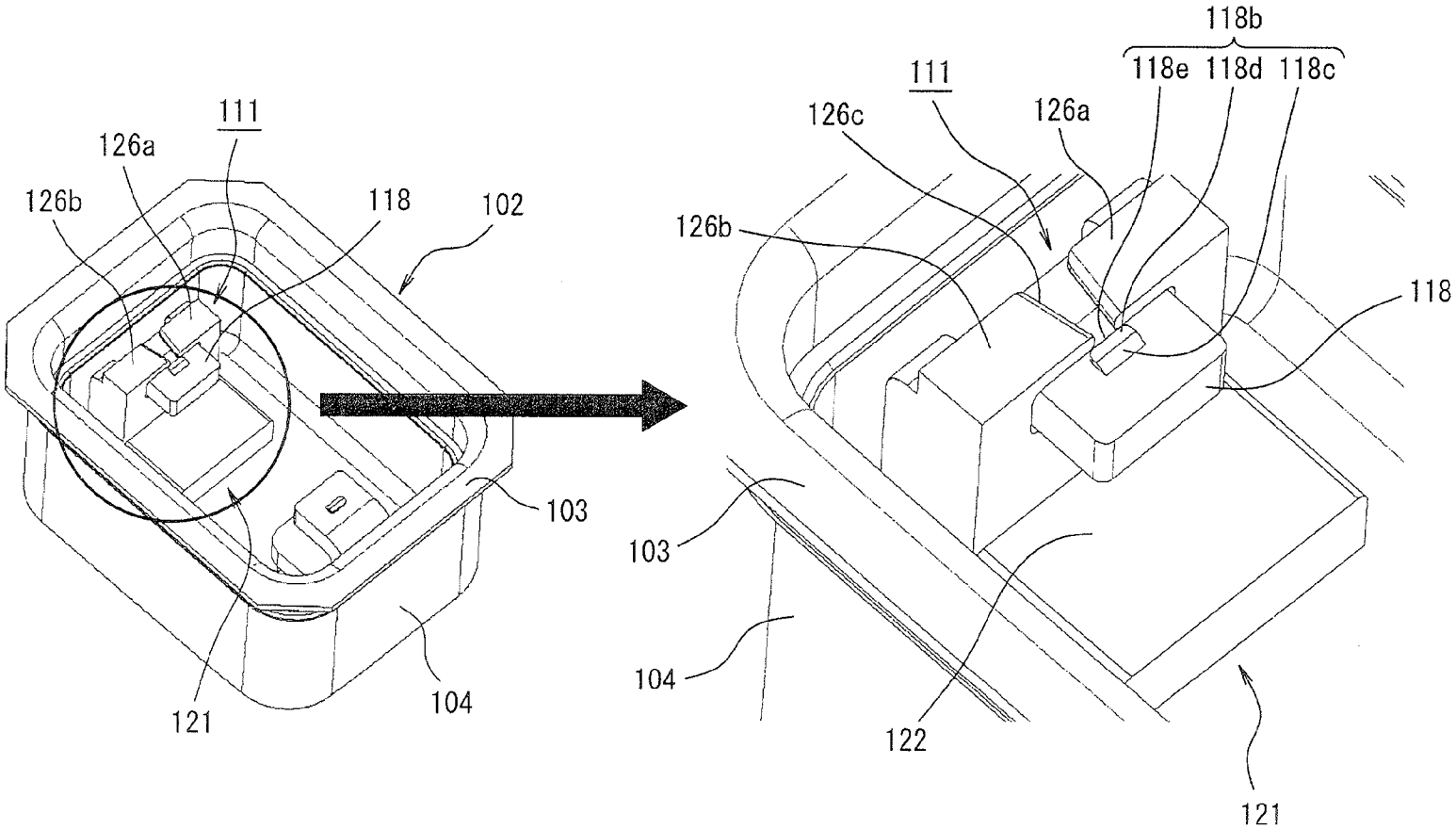
FIG. 8 is a perspective view showing an enlargement of a part of the insulation cover of another example.

The embodiments have described the case in which the insulation cover 121 is attached to the fixed contacts 111, 112 by fitting the fitted part 125 to the small diameter 114*b* formed in the support conductor 114 of the fixed contacts 111, 112. The present invention, however, is not limited to this configuration. Thus, a snap-fit part 126 for covering the lower plate part 118 of the C-shaped part 115 of the fixed contacts 111, 112 may be formed on the lower-surface side of the L-shaped plate part 122 of the insulation cover 121, as shown in FIG. 8.

This snap-fit part 126 is engaged with the protrusion 118*b* formed on the lower surface of the lower plate part 118 of the C-shaped part 115 of the fixed contacts 111, 112 and prevents the insulation cover from falling out. In other words, the snap-fit part 126 has a pair of L-shaped covering parts 126*a*, 126*b* that extends from either end surface in a front-back direction of the L-shaped part 122 to cover the lower plate part 118. As shown in FIG. 8, a tapering groove part 126*c* is formed between lower end surfaces of the covering parts 126*a*, 126*b* that face each other, so as to gradually increase the distance between the lower end surfaces from the inside to the outside. On the other hand, the protrusion 118*b* that is formed in the lower plate part 118 of the C-shaped part 115 of the fixed contacts 111, 112 is configured by an inclined surface 118*c* that gradually becomes tall from the inside to the outside, a flat surface 118*d* that extends outward from a lower end of the inclined surface 118*c* so as to be slightly parallel to the lower plate part 118, and a latched surface 110*e* that extends from an outside end surface of the flat surface 118*d* toward the lower surface of the lower plate part 118.

In order to install the insulation cover 121 in the C-shaped part 115 of the fixed contacts 111, 112, first, the fixed contacts 111, 112 are fixed to the arc-extinguishing chamber 102, as shown in FIG. 9(*a*). In this state, the fitted part 125 of the insulation cover 121 is caused to face the bottom plate part of the arc-extinguishing chamber 102 and inserted in a corresponding position between the fixed contacts 111, 112, as shown in FIG. 9(*b*).

Once the fitted part 125 of the insulation cover 121 contacts the bottom plate part arc-extinguishing chamber 102, the insulation cover 121 is moved outward to the C-shaped part 115, as shown in FIG. 9(*c*). Consequently, the lower plate part 118 of the C-shaped part 115 of the fixed contacts 111, 112 is inserted through the L-shaped covering parts 126*a*, 126*b*. In so doing, the tapering groove part 126*c* between the covering parts 126*a*, 126*b* is engaged with the inclined surface 118*c* of the protrusion 118*b* and bent upward. Thereafter, the tapering groove part 126*c* is engaged with the flat surface 118*d* and reaches the latched surface 118*e* provided outside the flat surface 118*d*, as shown in FIG. 9(*d*). As a result, the bent covering parts 126*a*, 126*b* return to their original state, and inner end surfaces of the covering parts 126*a*, 126*b* contact the latched surface 118*e* of the protrusion 118*b*, restricting the insulation cover 121 from moving inward. At the same time, the fitted part 125 is fitted to the small diameter part 114*b* of the support conductor 114 of each of the fixed contacts 111, 112, as described above.

As a result, the snap-fit part 126 can accurately position the insulation cover 121 in the lower plate part 118 with the contact point 118*a* provided in the fixed contacts 111, 112. Thus, the contact point 118*a* can reliably contact the movable contact 130 without being partially covered with the insulation cover 121. Moreover, due to the engagement between the snap-fit part 126 and the latched surface 118*e* of the protrusion 118*b*, the insulation cover 121 can reliably be prevented from falling out inward.

Figure 10:
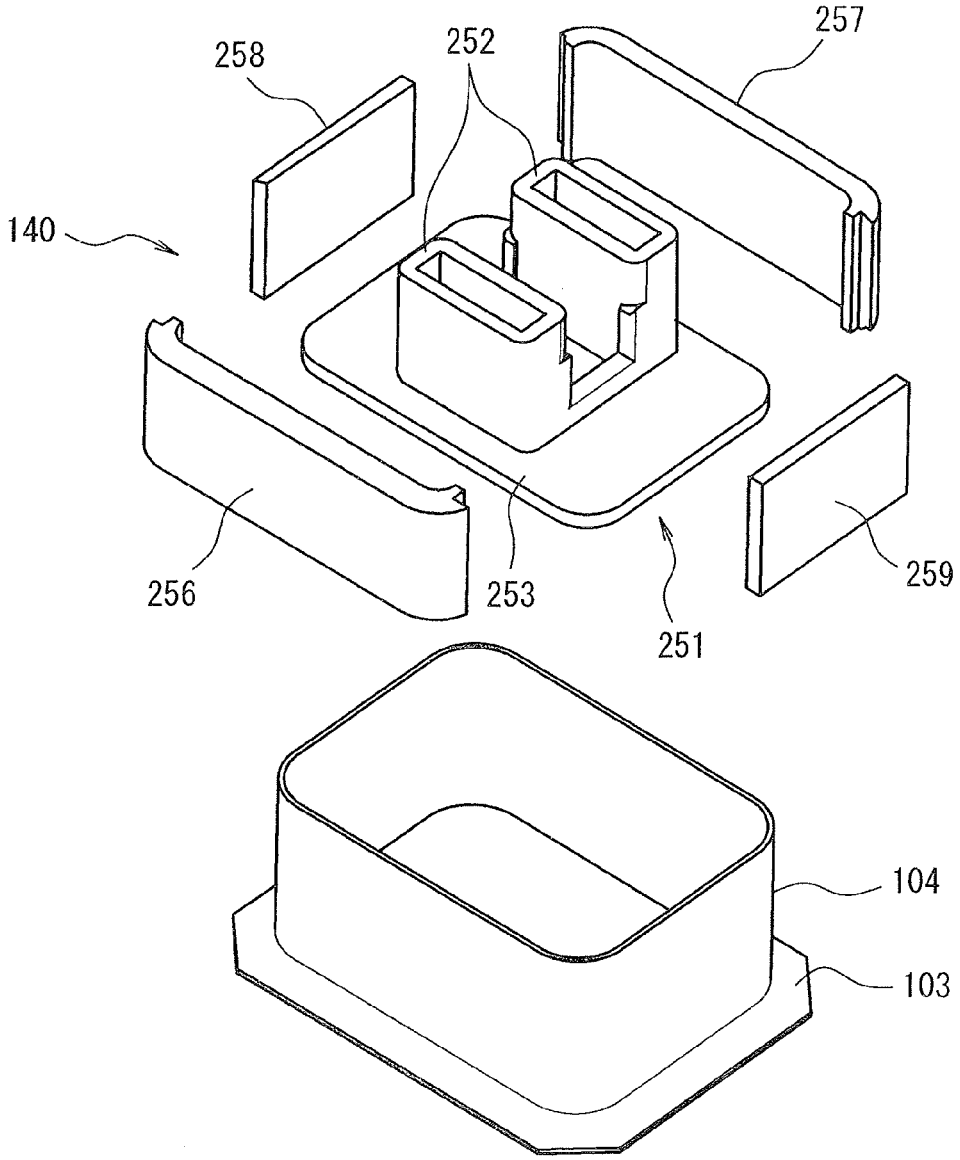
FIG. 10 is a perspective view showing another example of an insulating cylindrical body configuring the arc-extinguishing chamber.

The embodiments have described the case in which the bottom plate part 140*a* and the angular cylindrical body 140*b* of the insulating cylindrical body 140 are integrally formed. However, the configuration of the present invention is not limited thereto. As shown in FIG. 10, four side plate parts 256 to 259 configuring side walls may be disposed at front, rear, left, and right end parts of a bottom plate part 253 of a base member 251, and these side plate parts 256 to 259 may be coupled to form the insulating cylindrical body 140. In this case, because the side wall parts are divided into the four side plate parts 256 to 259, the electromagnetic contactor can be produced more easily compared to when integrally forming the whole pieces. In addition, an angular cylindrical body may be formed by integrating the four side plate parts 256 to 259.

The embodiments have also described the case in which the magnetic pole surfaces of the permanent magnets for arc extinguishing 143, 144 that face each other are configured as the N poles. However, the configuration of the present invention is not limited to this configuration. Thus, even when the magnetic pole surface of the permanent magnets for arc extinguishing 143, 144 that face each other are configured as the S poles, the same effects as those of the present embodiment can be obtained, except that the direction in which the magnetic flux passes across the arc and the direction of the Lorentz force are inverted.

Figure 11:
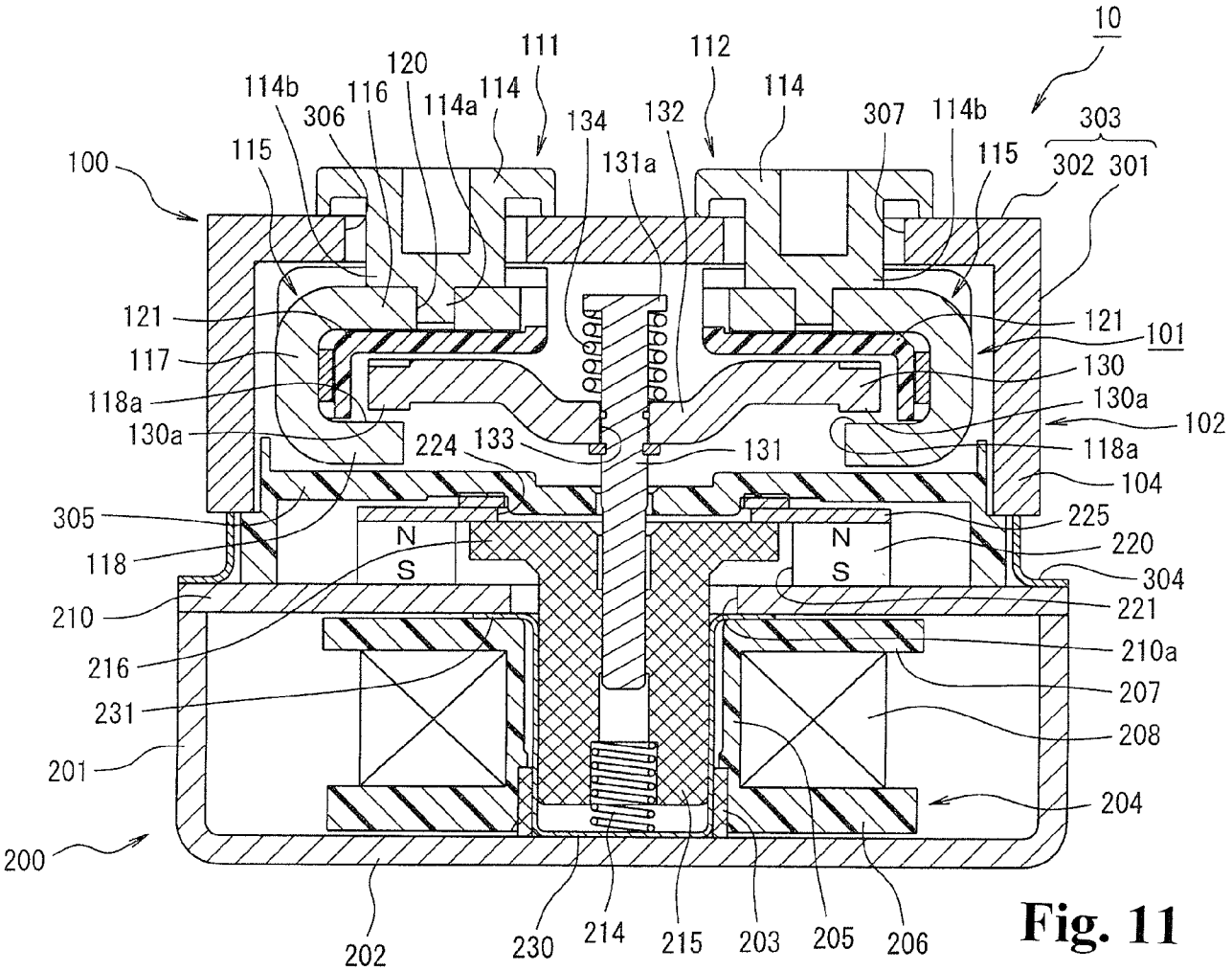
FIG. 11 is a cross-sectional diagram showing another example of the arc-extinguishing chamber.

The embodiments have also described the case in which the arc-extinguishing chamber 102 of the contact point device 100 is configured by the angular cylindrical body 104 and the fixed contact point supporting insulating substrate 105. However, the configuration of the present invention is not limited to this configuration, and other configurations can be adopted. For instance, an angular cylindrical part 301 and a top panel part 302 sealing the upper end of the angular cylindrical part 301 may be integrally molded into a tub-shaped body 303 by means of ceramic or other synthetic resin, as shown in FIGS. 11 and 2(*b*), and then an open end surface of the tub-shaped body 303 may be metalized to form metal foil. Then, a metallic connecting member 304 may be seal-bonded to the metal foil to form the arc-extinguishing chamber 102.

Figure 12A:
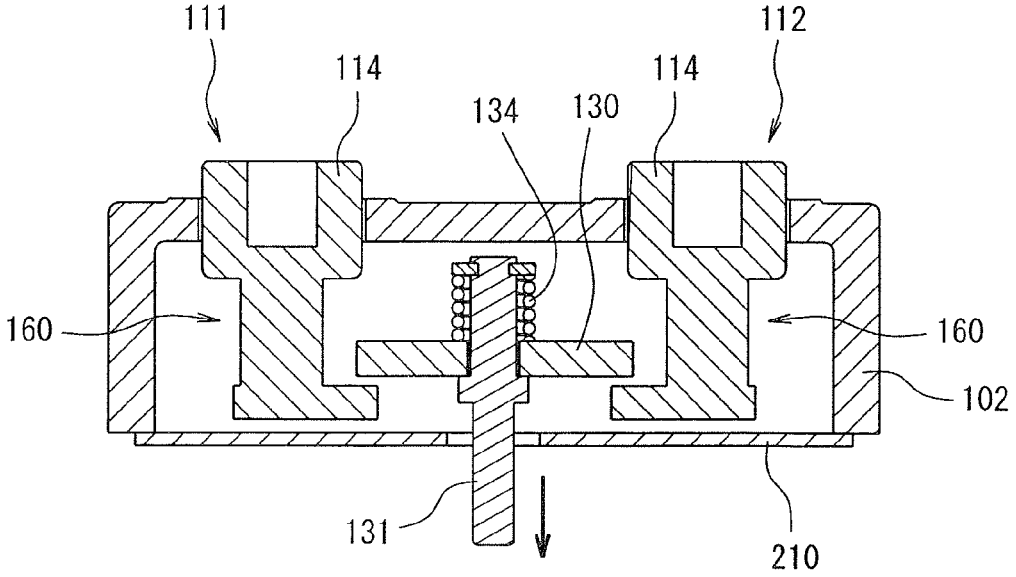
FIGS. 12(*a*), 12(*b*) show diagrams of another example of the contact point mechanism, wherein FIG. 12(*a*) is a cross-sectional diagram and FIG. 12(*b*) is a perspective view.
Figure 12B:
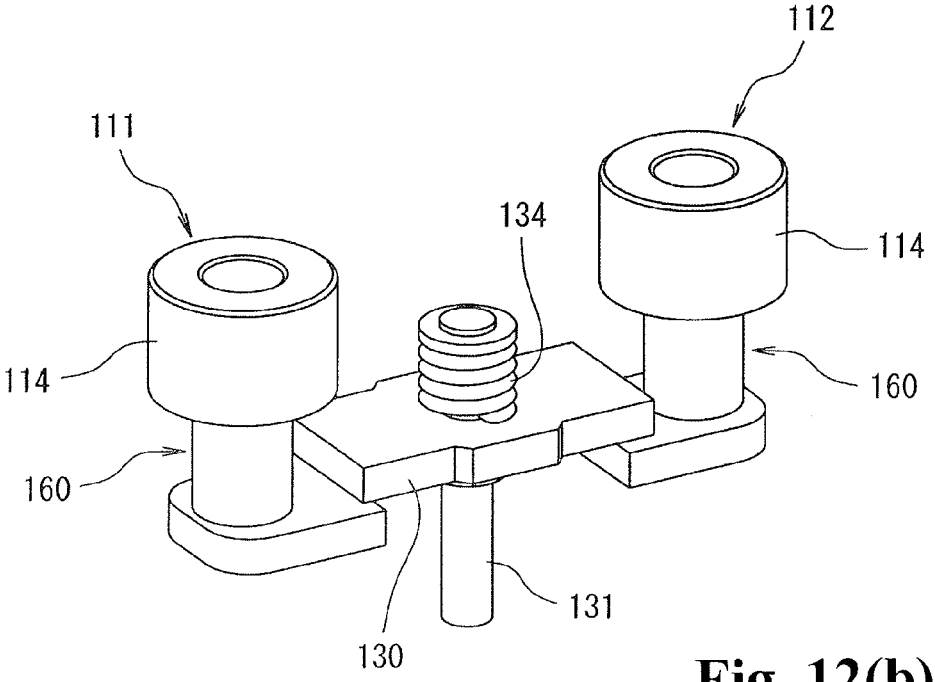

The embodiments have also described the case in which the C-shaped part 115 is formed in each of the fixed contacts 111, 112. However, the configuration of the present invention is not limited to this configuration. As shown in FIGS. 12(*a*) and 12(*b*), an L-shaped part 160 without the upper plate part 116 of the C-shaped part 115 may be coupled to the support conductor 114.

In this case as well, in the closed pole state where the movable contact 130 contacts the fixed contacts 111, 112, the magnetic flux generated by the current flowing through a vertical plate part of the L-shaped palls 160 can be caused to act on the contact part between the fixed contacts 111, 112 and the movable contact 130. As a result, the magnetic flux density of the contact point between each of the fixed contacts 111, 112 and the movable contact 130 can be increased, generating the Lorentz force that acts against the electromagnetic force.

Figure 13A:
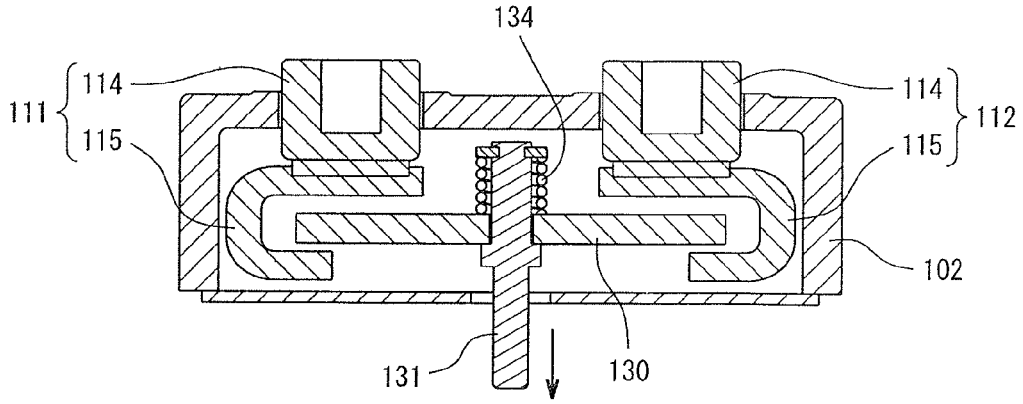
FIGS. 13(*a*), 13(*b*) show diagrams of another example of a movable contact of the contact point mechanism, wherein FIG. 13(*a*) is a cross-sectional diagram and FIG. 13(*b*) is a perspective view.
Figure 13B:
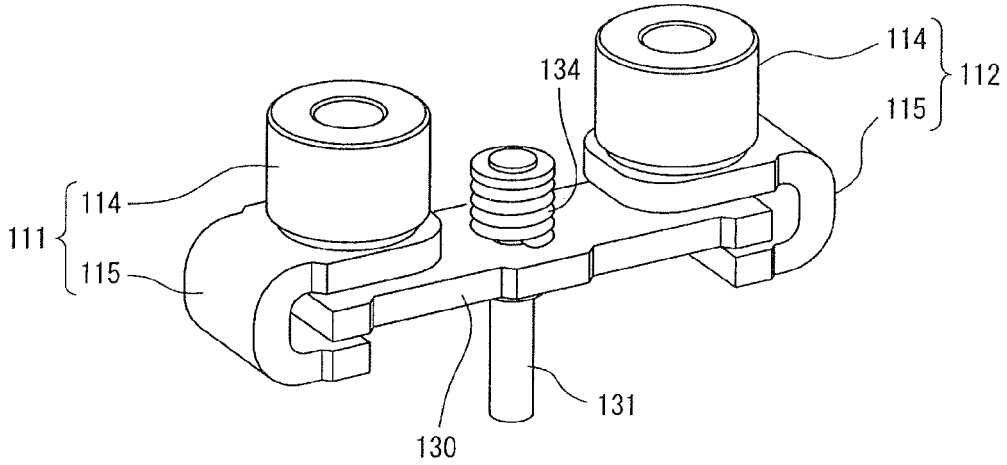

The embodiments have also described the case in which the movable contact 130 has the concave part 132 in the middle thereof. However, the configuration of the present invention is not limited to this configuration. As shown in FIGS. 13(*a*), 13(*b*), the concave part 132 may be omitted to form the movable contact 130 into a flat shape.

The first and second embodiments have described the case in which the coupling shaft 131 is screwed to the movable plunger 215; however, the movable plunger 215 and the coupling shaft 131 may be formed integrally.

The above has described the case in which the coupling shaft 131 and the movable contact 130 are coupled to each other by forming the flange part 131*a* in the tip end part of the coupling shaft 131, inserting the contact spring 134 and the movable contact 130, and then fixing the lower end of the movable contact 130 with the C ring. However, the configuration of the present invention is not limited to this configuration. In other words, a positioning large diameter part that protrudes radially may be formed in the position of the C ring of the coupling shaft 131, and the movable contact 130 may be brought into abutment against this positioning large diameter part. Subsequently, the contact spring 134 may be disposed and an upper ring of the contact spring 134 may be fixed using the C ring.

The configuration of the electromagnetic unit 200 is not limited to the configurations described in the embodiments; thus, an electromagnetic unit of any configuration can be applied to the present invention.

The present embodiment has described the case in which the airtight container is configured with the arc-extinguishing chamber 102 and the cap 230; however, when the level of the current to be interrupted is low, the gas may not be encapsulated.

EXPLANATION OF REFERENCE NUMERALS

10 . . . Electromagnetic contactor, 100 . . . Contact point device, 101 . . . Contact point mechanism, 102 . . . Arc-extinguishing chamber, 104 . . . Angular cylindrical body, 105 . . . Fixed contact point supporting insulating substrate, 111, 112 . . . Fixed contact, 114 . . . Support conductor, 115 . . . C-shaped part, 116 . . . Upper plate part, 117 . . . Intermediate plate part, 118 . . . Lower plate part, 118*a* . . . Contact point part, 121 . . . Insulation cover, 122 . . . L-shaped plate part, 123, 124 . . . Side plate part, 125 . . . Snap-fit part, 130 . . . Movable contact, 130*a* . . . Contact point part, 131 . . . Coupling shaft, 132 . . . Concave part, 134 . . . Contact spring, 140 . . . Insulating cylindrical body, 141, 142 . . . Magnetic storage pocket, 143, 144 . . . Permanent magnet for arc extinguishing, 145, 146 . . . Arc-extinguishing space, 160 . . . L-shaped part, 200 . . . Electromagnetic unit, 201 . . . Magnetic yoke, 203 . . . Tubular auxiliary yoke, 204 . . . Spool, 208 . . . Exciting coil, 210 . . . Upper magnetic yoke, 214 . . . Return spring, 215 . . . Movable plunger, 216 . . . Peripheral flange part, 220 . . . Permanent magnet, 225 . . . Auxiliary yoke, 230 . . . Cap

What is claimed is:

1. A method for assembling an arc-extinguishing chamber of an electromagnetic contactor, comprising:

a step of fixing a pair of fixed contacts each including a support conductor and a C-shaped part, to the arc-extinguishing chamber having a tub-shape with one end being open, the C-shaped part being disposed inside of the arc-extinguishing chamber;

a step of installing an insulation cover covering a part other than a contact point part of each C-shaped part of the pair of fixed contacts; and a step of disposing a movable contact to be capable of contacting with and separating from the contact point parts of the fixed contacts, wherein the arc-extinguishing chamber comprises:

a flat fixed contact point supporting insulating substrate supporting the pair of fixed contacts;

a metallic angular cylindrical body brazed to the fixed contact point supporting insulating substrate; and an insulating cylindrical body disposed on an inner circumferential surface of the metallic angular cylindrical body.

* * * * *